US006571917B1

(12) United States Patent
Hyun

(10) Patent No.: US 6,571,917 B1
(45) Date of Patent: Jun. 3, 2003

(54) LINEAR COMPRESSOR

(75) Inventor: Seong Yeol Hyun, Changwon (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 09/623,117

(22) PCT Filed: Dec. 27, 1999

(86) PCT No.: PCT/KR99/00822

§ 371 (c)(1),
(2), (4) Date: Aug. 25, 2000

(87) PCT Pub. No.: WO00/39462

PCT Pub. Date: Jul. 6, 2000

(30) Foreign Application Priority Data

Dec. 28, 1998 (KR) ..... 98-59384

(51) Int. Cl.[7] ..... F01M 1/00
(52) U.S. Cl. ..... 184/6.16; 417/211; 417/415
(58) Field of Search ..... 184/6.16; 417/415, 417/417, 211

(56) References Cited

U.S. PATENT DOCUMENTS 5,993,175 A * 11/1999 Kim et al. ..... 417/417
6,089,352 A * 7/2000 Kim et al. ..... 184/6.16
6,202,791 B1 * 3/2001 Oh et al. ..... 184/6.16
6,220,393 B1 * 4/2001 Oh et al. ..... 184/6.16
6,299,421 B1 * 10/2001 Oh et al. ..... 417/571

FOREIGN PATENT DOCUMENTS

| | | |
|---|---|---|
| JP | 54-31202 | 3/1979 |
| JP | 56-13557 | 2/1981 |
| JP | 56-129780 | 10/1981 |

* cited by examiner

*Primary Examiner*—David Fenstermacher
(74) *Attorney, Agent, or Firm*—Ostrolenk, Faber, Gerb & Soffen, LLP

(57) ABSTRACT

A linear compressor including a well-closed container filled with oil at its bottom; a compressive unit having a frame of a hollow inside the well-closed container to which a cylinder inserted, a piston inserted into the hollow of the cylinder, for linearly moving upward and downward by driving of a motor installed at the cylinder, and a discharge cover for covering one end of the cylinder; and an oil supply unit mounted at the lower side of the compressive unit, for pumping oil, wherein the oil supplied from the 01 oil supply unit to the compressive unit exists within the compressor unit in either case that the compressor is operated or stopped. Accordingly, even when the compressor is stopped, the oil remains in the compressive unit, so that when the compressor is re-started, the friction portion between the cylinder and the piston is lubricated, preventing abrasion of the friction portion. Thus, a reliability of the compressor is highly improved.

4 Claims, 5 Drawing Sheets

LINEAR COMPRESSOR

TECHNICAL FIELD

The present invention relates to a linear compressor, and more particularly, to a linear compressor having an oil supply structure suitable for a smooth lubricating operation, so as to prevent abrasion at a friction portion between a cylinder and a piston according to shortage of oil.

BACKGROUND ART

Generally, a linear compressor compresses a coolant gas by directly and reciprocally moving a piston by means of a magnet or a coil instead of a crank shaft, one example of which is as shown in FIGS. 1 and 2.

FIG. 1 is a vertical-sectional view of a general linear compressor in accordance with a conventional art, and FIG. 2 is a vertical-sectional view of an oil supply structure of the linear compressor in accordance with the conventional art.

As shown in the drawings, the general linear compressor includes a compressive unit 40 installed in a well-closed container 1 having a predetermined form in the horizontal direction for sucking, compressing and discharging a coolant, and an oil supply unit 50 fixed at an outside of the compressive unit 40 for supplying oil toward inside the compressive unit 40, especially, to the friction portion between a cylinder 3 and the piston 6 (to be described).

The compressive unit 40 includes a circular frame 1; a cover 2 fixedly installed at one side of the frame 1; a cylinder 3 fixedly installed at the center of the frame 1 in the horizontal direction; an inner lamination assembly 4A fixedly installed at the outer circumfer00ential surface of the frame 1 which supports the cylinder 3; an outer lamination assembly 4B fixedly installed at the inner circumferential surface of the frame 1, having a void with the inner lamination assembly 4A, for forming an induction magnetic field together with the inner lamination assembly 4A; a magnet assembly 5 insertedly positioned in the void between the inner lamination assembly 4A and the outer lamination assembly 4B, consisting of a magnet 5*a* and a magnet paddle 5*b*, and linearly and reciprocally moving by the induction magnetic field; a piston 6 integrally fixed at the magnet assembly 5 and linearly and reciprocally moving as being inserted into the cylinder 3 to suck and compress the coolant gas, the piston being elastically supported by the cover 2; a suction valve 7 mounted at the front end face of the piston 6; and a discharge cover 10 installed at the front end portion of the cylinder 3 and having a discharge valve assembly 11 inside thereof.

As shown in FIG. 2, oil inlet passage 1*a* communicated with the oil supply unit 50 is formed at the frame 1 in the hollow direction along the cylinder 3. A first circular oil groove 1*b* is formed on the inner circumferential surface of the cylinder 3, communicating with the oil inlet passage 1*a*. At least one oil through hole 3*a* for supplying oil to the friction portion with the piston 6 is formed at the cylinder 3 facing the first oil groove 1*b*. A second circular oil groove 6*b* is formed at the outer circumferential surface of the piston 6, communicating with the oil through hole 3*a*. An oil communicating path 1*c* at the inner circumferential surface of the cylinder 3 at the side facing the oil inlet passage 1*a*, communicating with the first oil groove 1*b*. The oil communicating path 1*c* is communicated with a oil circulation path 1*d* formed at the end portion thereof when the frame 1 is combined to the cylinder 3. An oil discharge hole 1*e* is formed at the lower side of the oil circulation path 1*d*.

Meanwhile, the oil supply unit 50 includes an oil cylinder 21 attached on the bottom of the compressive unit 40; an oil piston 22 inserted into the oil cylinder 21 to divide the cylinder to the suction space and a discharge space, and having an oil communicating hole 22*a* for communicating the suction space and the discharge space; a first and a second oil springs 23A and 23B for elastically supporting the both ends of the oil piston 22 against the oil cylinder 21; a suction cover 24 and a discharge cover 25 for supporting each other end of the first and the second oil springs 23A and 23B and fixing the both ends of the oil cylinder 21 to the compressive unit 40; an oil suction valve 26 supported by the first oil spring 23A at the outlet side of the oil piston 22; and an oil discharge valve 27 installed at the outlet side, of the oil cylinder 21.

Reference numeral 4*b* denotes a coil assembly, 6*a* denotes a coolant passage, 8 denotes a main spring and 9 denotes a suction pipe.

The operation of the linear compressor constructed as described above will now be explained.

First, when an induction magnetic field is generated as current is applied to a stator of a linear motor consisting of the inner lamination assembly 4A and the outer lamination assembly 4B, the magnet assembly 5, a rotor in the void between the inner lamination assembly 4A and the outer lamination assembly 4B linearly reciprocates owing to the induction magnetic field, so that the piston 6 moves reciprocally in the cylinder 3. Due to the piston's reciprocal movement in the cylinder 3, the coolant gas introduced into the well-closed container 30 is sucked into the compressed space 'C' of the cylinder through the coolant passage 6*a* formed at the center of the piston 6. The compressed gas opens the discharge valve assembly 11 to be discharged to the outside from the discharge cover 10. These processes are repeatedly performed.

In the above process, the oil supply unit 50 vibrates along with the compressive unit 40, pumping the oil filling the bottom of the well-closed container 30 to supply it to the compressive unit 40. The oil pumped from the oil supply unit 50 is induced to the first oil groove 1*b* through the oil inlet passage 1*a*.

The oil induced to the first oil groove 1*b* fills the second oil groove 6*b* through the through hole 3*a*, cooling the cylinder 3, and lubricates the friction portion between the cylinder 3 and the piston 6.

Thereafter, after lubricating the friction portion between the cylinder 3 and the piston 6, the oil is induced to the other first oil groove 1*b* through the other oil through hole 3*a*, cooling the discharge cover 10 along the oil communicating path 1*c* and the oil circulation path 1*d* together with the oil that filled the first oil groove 1*b*, and returns to the well-closed container 30 through the oil discharge hole 1*e*.

However, the linear compressor of the conventional art as described above has problems in that since the oil inlet passage 1*a* of the frame and the oil through hole 3*a* of the cylinder 3 are linearly formed to the compressive unit 40, when the compressor is stopped, the oil filling the first oil groove 1*b* of the frame 1 and the second oil groove 6*b* of the piston 6 flows out through the oil of inlet passage 1*a*, being taken out toward the oil supply unit 50 and the well-closed container 30, resulting in that when the compressor is actuated again, friction occurs at the friction portion between the cylinder 3 and the piston 6 due to the oil shortage until the oil is re-supplied to the friction portion, and due to the friction, the piston or the cylinder may be abraded.

TECHNICAL TASK OF THE INVENTION

Accordingly, in order to overcome the problems of the conventional linear compressor, an object of the present invention is to provide a linear compressor having an oil backflow prevention device by which oil always exists at the friction portion between a cylinder and a piston so that even when a compressor is stopped and re-started, the friction portion is smoothly lubricated.

DISCLOSURE OF THE INVENTION

In order to accomplish the above object, there is provided a linear compressor including a well-closed container filled with oil at its bottom, a compressive unit having a frame of a hollow inside the well-closed container to which a cylinder inserted, a piston inserted into the hollow of the cylinder, for linearly moving upward and downward by driving of a motor installed at the cylinder, and a discharge cover for covering one end of the cylinder, and an oil supply unit mounted at the lower side of the compressive unit, for pumping oil, wherein the oil supplied from the oil supply unit to the compressive unit exists within the compressor unit in either case that the compressor is operated or stopped.

MODES FOR CARRYING OUT THE PREFERRED EMBODIMENTS

A linear compressor having an oil supply structure in accordance with the present invention will now be described with reference to the accompanying drawings.

Figure 1:
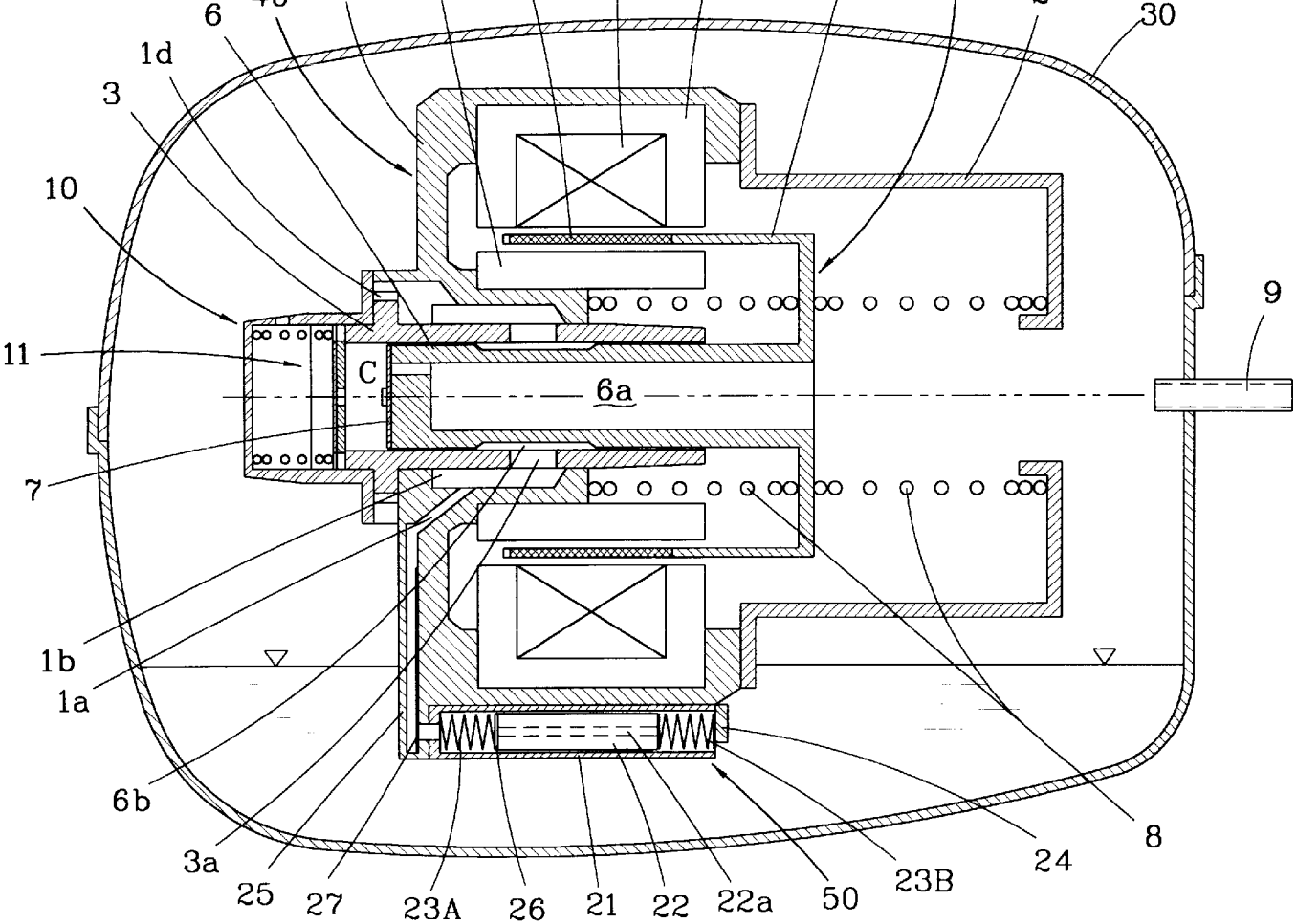
FIG. 1 CONVENTIONAL ART
FIG. 1 is a vertical-sectional view of a general linear compressor showing its internal structure in accordance with a conventional art.
Figure 2:
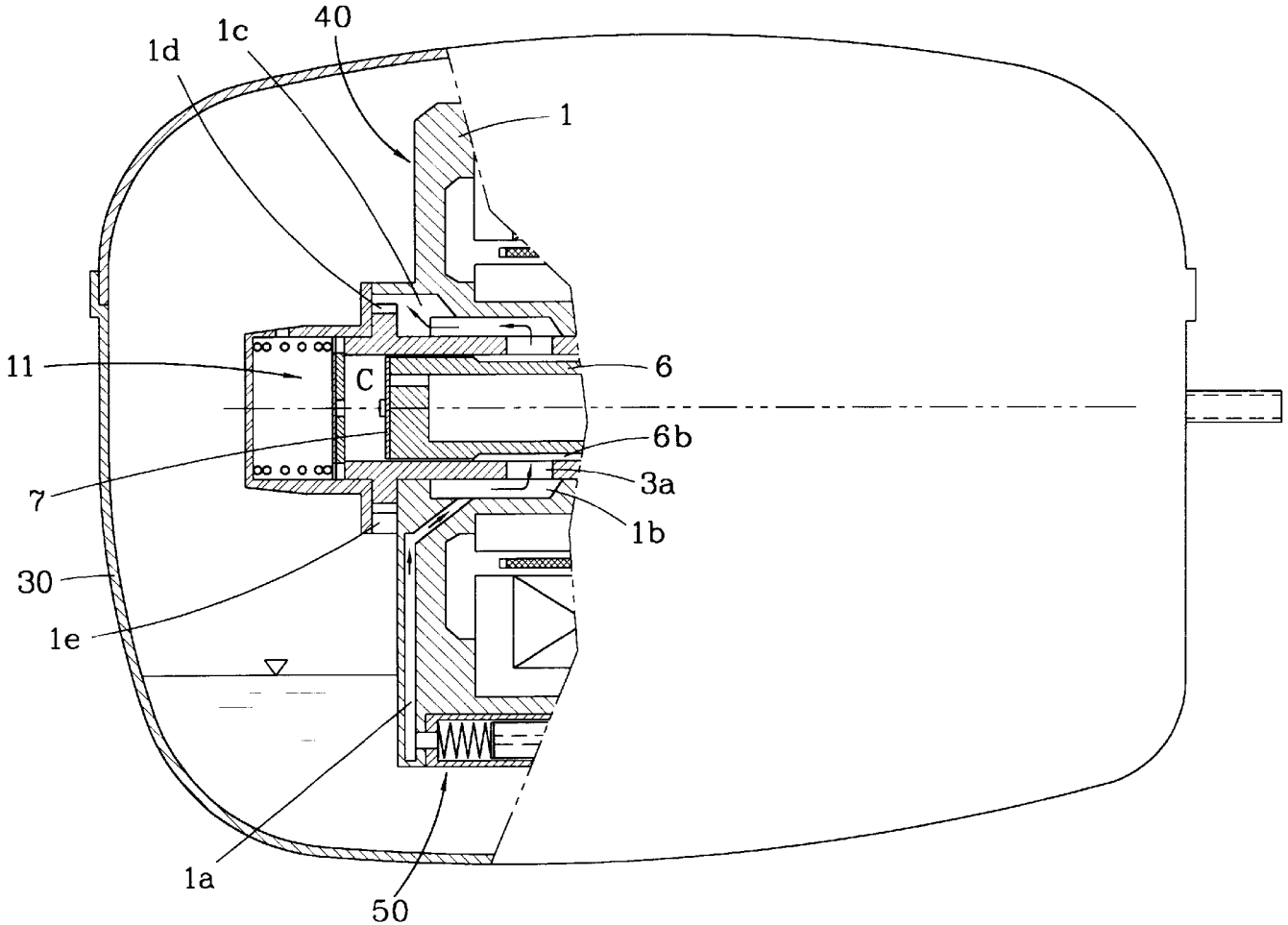
FIG. 2 CONVENTIONAL ART
FIG. 2 is a partial vertical-sectional view of the general linear compressor showing an oil supply structure in accordance with the conventional art.
Figure 3:
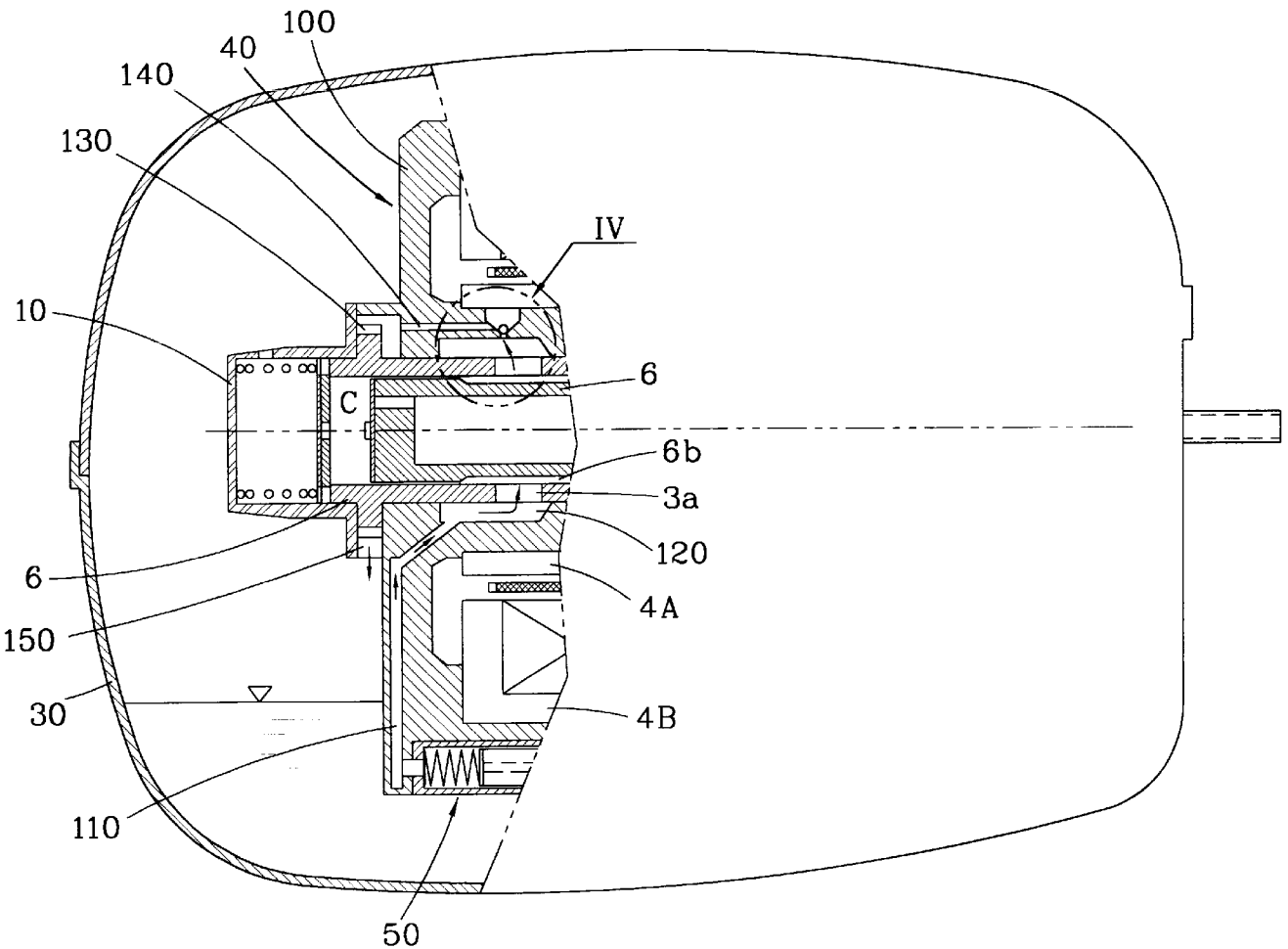
FIG. 3 is a vertical-sectional view of a linear compressor adopting an oil supply structure in accordance with the present invention.
Figure 4A:
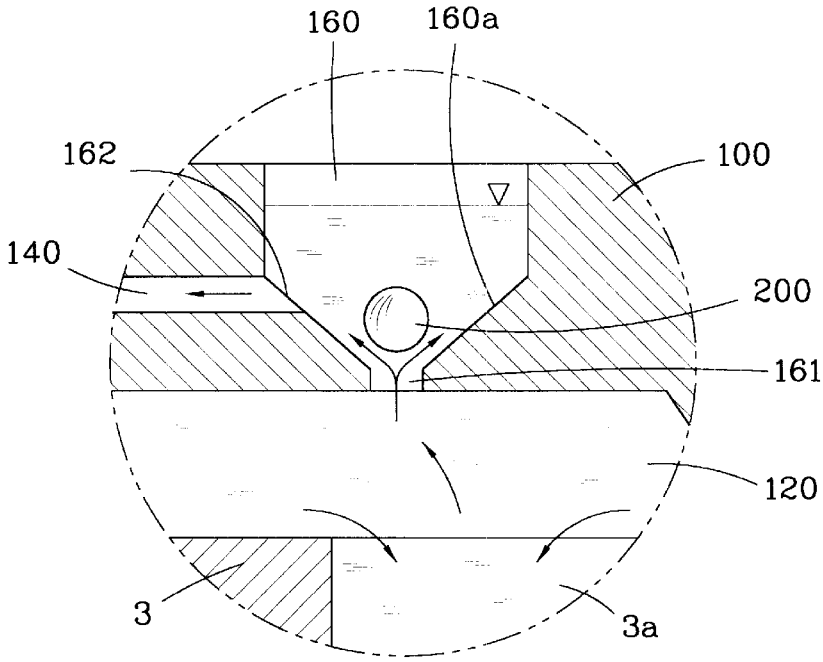
FIGS. 4A through 4C are enlarged view of the IV portion of FIG. 3 illustrating each operation of the linear compressor having the oil supply structure in accordance with the present invention.
Figure 4B:
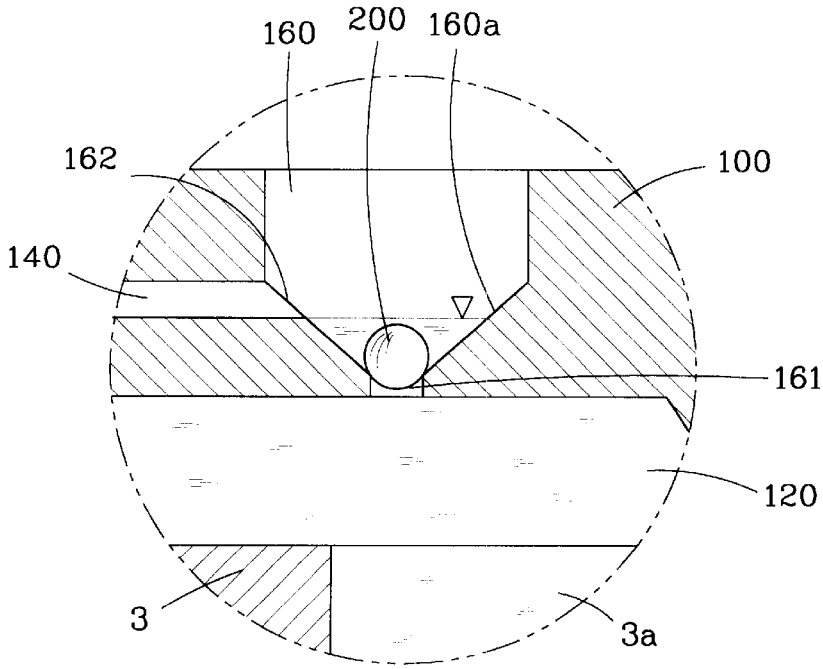
Figure 4C:
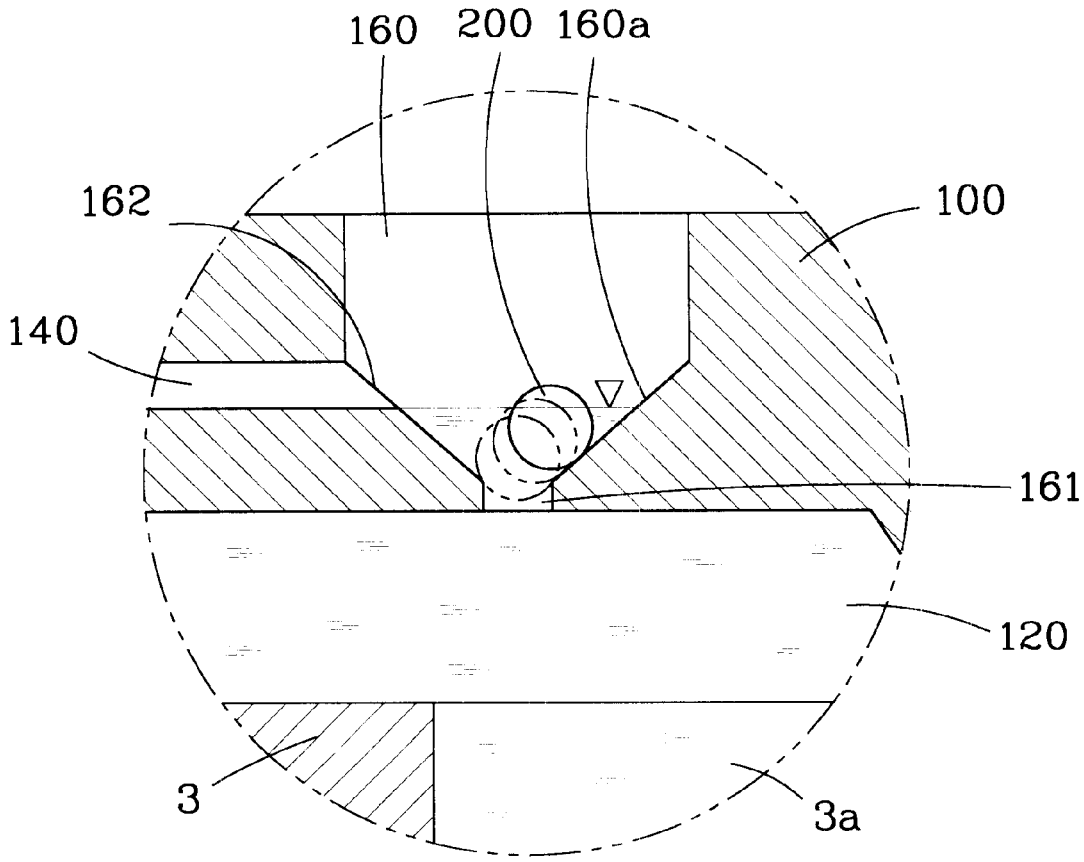

FIG. 3 is a vertical-sectional view of a linear compressor adopting an oil supply structure in accordance with the present invention; and FIGS. 4A through 4C are enlarged view of the IV portion of FIG. 3 illustrating each operation of the linear compressor having the oil supply structure in accordance with the present invention.

The same reference numerals are given for the same construction elements as in the conventional art, and descriptions for the same elements are omitted.

As shown in the drawings, the linear compressor having an oil supply structure includes a well-closed container 30 filled with oil at its bottom, a frame 100 installed inside the well-closed container 30; a cylinder 3 inserted into a hallow formed at the center of the frame 100; a piston 6 inserted in the cylinder 3 and moving linearly upward and downward by the driving of the motor; a discharge cover 10 combined to one end of the cylinder 3 to be opened; and an oil supply unit 50 mounted at the lower portion of the frame 100 and supplying oil into the compressive unit 40 which pumps the oil.

The structure for supplying the oil pumped by the oil supply unit 50 into the compressive unit 40 will now be described. First, an oil inlet passage 110 communicating with the discharging side of the oil supply unit 50 is formed inside the frame 100, and a first circular oil groove 120 communicating with the oil inlet passage 110 is formed at the hollow face of the cylinder 3.

An oil through hole 3*a* for inducing the oil of the first oil groove 120 to the friction portion between the cylinder 3 and the piston 6 is formed passing through the cylinder 6, and a second circular oil groove 6*b* is formed at the outer circumferential surface of the piston 6 so as to provide the oil induced to the oil through hole 3*a* to the friction portion between the cylinder 3 and the piston 6.

A circular oil circulation path 130 is formed by the outer circumferential surface of one end portion of the cylinder 3 and the inner circumferential surface of the one end portion of the frame 100 and the discharge cover 10. An oil communicating path 140 for communicating the oil circulation path 130 and the first oil groove 120 is formed at the frame 100 at the side facing the oil inlet passage 110. An oil discharge hole 150 for returning the oil that circulated the oil circulation path 130 to the well-closed container 30 is formed at the lowermost place of the oil circulation path 130.

An oil opening and closing unit 160 of a nozzle form or a funnel shape (having a form of which diameter becomes small as it goes to its lower side) is formed between the first oil groove 120 and the oil communicating path 140.

An oil flow hole 161 is formed at the lowermost portion of the oil opening and closing unit 160, communicating with the first oil groove 120, and an oil discharge hole 162 is formed for communicating the oil supplied from the oil flow hole 161 with the oil communicating path 140.

A spherical opening and closing member 200 is mounted at the oil flow hole 161 of the oil opening and closing unit 160, serving as a valve. When the compressor is operated, the opening and closing member 200 opens the oil flow hole 161 by the pressure of the supplied oil, to render the first oil groove 120 communicated with the oil communicating path 140, while when the compressor is stopped, the opening and closing member 200 closes the oil flow hole 161, blocking the first oil groove 120 and the oil communicating path 140 so that the oil remains between the first oil groove 120 and the oil inlet passage 110 and in the friction portion between the cylinder 3 and the piston 6.

Thereafter, when the compressor is re-started, the opening and closing member 200 reopens the oil opening and closing unit 160, rendering the first oil groove 120 to be communicated with the oil communicating path 140, thereby smoothly supplying the oil.

Meanwhile, when the compressor is stopped, a predetermined amount of residual oil fills the oil opening and closing unit 160 and is supplied to the friction portion between the cylinder 3 and the piston 6 through the opening of the oil opening and closing unit 160 by virtue of the vibration generating when the compressor is re-started.

Reference numeral 160*a* denotes an inclination portion of the oil opening and closing unit 160.

The operation of the linear compressor having the oil supply structure of the present invention constructed as described above will now be explained.

When a current is applied to a stator of the linear motor consisting of the inner lamination assembly 4A and the outer lamination assembly 4B and an induction magnetic field is generated, the magnet assembly 5, a rotor, reciprocally moves linearly between the inner lamination assembly 4A and the outer lamination assembly 4B by virtue of the induction magnetic field, and accordingly, the piston 6 is reciprocally moved within the cylinder 3.

According to the reciprocal movement of the piston 6 in the cylinder 3, the coolant gas induced into the well-closed container 30 is sucked into the compressive space C of the cylinder 3 through the cooling passage 6*a* formed at the center of the piston 6, and then compressed and discharged outside. These processes are repeatedly performed.

Here, as the oil supply unit 50 is vibrated along with the compressive unit 40, the oil filling the bottom of the well-closed container 30 is pumped and supplied to the compressive unit 40.

The oil pumped from the oil supply unit 50 flows into the first oil groove 120 through the oil inlet passage 110 of the frame 100. The oil flowed into the first oil groove 120, cooling the cylinder 3, fills the second oil groove 6*b* of the piston 6 through the oil through hole 3*a*, so as to be supplied to the friction portion between the cylinder 3 and the piston 6.

Thereafter, the oil that lubricated the friction portion between the cylinder 3 and the piston 6 is discharged to the other first oil groove 120 through the other oil through hole 3*a*, which flows through the oil opening and closing unit 160, the oil communicating path 40 and the oil circulation path 130 together with the oil that filled the first oil groove 120, cooling the discharge cover 10, and returns to the lower portion of the well-closed container 30 through the oil discharge hole 150.

At this time, as shown in FIG. 4A, the opening and closing member 200 inserted in the oil opening and closing unit 160 between the first oil groove 120 and the oil communicating path 140 is pushed up by virtue of the oil discharged through the first oil groove 120 and the oil flow hole 161 of the oil opening and closing unit 160, so that the oil flow hole 161 is opened and the first oil groove 130 and the oil communicating path 140 are communicated each other, and thus, the oil is smoothly circulated through the above described passage.

Meanwhile, in case that the compressor is stopped, the oil that thrust the opening and closing member 200 in the above case is discharged toward the oil supply unit 50 through the oil inlet passage 110, but as shown in FIG. 4B, the opening and closing member 200 is downed by self-weight along the sloping side 160*a* of the oil opening and closing unit 161, thereby closing the oil flow hole 161.

When the oil flow hole 161 is closed, the oil is tied up from the first oil groove 120 to the oil inlet passage 110, remaining at the friction portion between the cylinder 3 and the piston 6 as well as remaining at the oil opening and closing unit 160. Thereafter, as shown in FIG. 4C, at the time when the compressor is re-started, the compressive unit 40 is vibrated, according to which the opening and closing member 200 is vibrated within the oil opening and closing unit 160, partially opening the oil flow hole 161. Through the opening of the oil flow hole 161; the residual oil remaining at the oil opening and closing unit 160 is supplied to the first oil groove 120, and at the same time, the oil that remained at the friction portion between the cylinder 3 and the piston 6 when the compressor was stopped lubricates the friction portion.

Meanwhile, when the compressor is operated normally again, as mentioned above, the opening and closing member 200 is completely separated from the oil flow hole 161 of the oil opening and closing unit 160, so that the oil is smoothly circulated through the above stated passage.

As so far described, according to the linear compressor having the oil supply structure of the present invention, even when the compressor is stopped, the oil remains in the compressive unit, so that when the compressor is re-started, the friction portion between the cylinder and the piston is lubricated, preventing abrasion of the friction portion. Thus, a reliability of the compressor is highly improved.

What is claimed is:

1. A linear compressor including a well-closed contained filled with oil at its bottom; a compressive unit having a frame of a hollow inside the well-closed container in which a cylinder is inserted, a piston inserted into the hollow of the cylinder, for linearly moving upward and downward by driving of a motor installed at the cylinder, and a discharge cover for covering one end of the cylinder; and an oil supply unit mounted at the lower side of the compressive unit, for pumping oil, wherein the oil supplied from the oil supply unit to the compressive unit exists within the compressor unit in either case that the compressor is operated or stopped;

the oil supply unit comprising:

an oil inlet passage formed so that the oil supplied from the oil supply unit is induced toward the hollow of the frame;

a first oil groove formed at the inner circumferential surface of the frame, communicating with the oil inlet passage;

an oil through bole formed penetrating the cylinder to render oil to be induced to the friction portion between the cylinder and the piston;

a second oil groove formed at the outer circumferential surface of the piston, to provide oil to the friction portion between the cylinder and the piston; an oil circulation path formed by the outer circumferential surface of one end portion of the cylinder, the inner circumferential surface of one end portion of the frame, and the discharge cover;

an oil communicating path for rendering the oil circulation path and the first oil groove to be communicated with the frame at the side facing the oil inlet passage;

an oil discharge hole formed at the lowermost portion of the oil circulation path;

a nozzle-shaped oil opening and closing portion formed between the first oil groove and the oil communicating path, of which diameter becomes small as nearing the lower portion thereof; and an opening and closing member positioned within the oil opening and closing unit, for opening and closing the oil opening and closing unit and the communicating portion of the first oil groove.

2. The linear compressor according to claim 1, wherein the opening and closing member is operated according as the compressor is operated and stopped.

3. The linear compressor according to claim 2, wherein when the compressor is operated, the opening and closing member opens the inlet of the oil opening and closing unit by virtue of the pressure of the oil supplied through the first oil groove, so that the first oil groove and the oil communicating path are communicated to each other, while when the compressor is stopped, the opening and closing member closes the inlet of the oil opening and closing unit to block the first oil groove and the oil communicating path.

4. A linear compressor, comprising:

a well-closed container filled with oil at a bottom thereof, a compressor unit having a frame that defines a hollow interior inside the well-closed container;

a cylinder inside the compressor unit and a piston in the cylinder, which linearly reciprocates within the cylinder through the action of a motor installed at a cylinder;

a discharge cover for covering one end of the cylinder;

an oil supply unit mounted at one side of the compressor unit for pumping oil into the compressor unit for pumping oil into and out of the compressor unit through an oil path; and a valve structure in the oil path which is structured to retain oil within the compressor unit regardless of whether or not the compressor motor is being operated.

* * * * *